US007193510B2

(12) United States Patent
Nickels

(10) Patent No.: US 7,193,510 B2
(45) Date of Patent: Mar. 20, 2007

(54) SAFETY INTERLOCK CIRCUIT WITH DIAGNOSTICS REQUIRING NO EXTRA SIGNAL WIRES

(75) Inventor: Robert A. Nickels, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 201 days.

(21) Appl. No.: 11/125,896

(22) Filed: May 2, 2005

(65) Prior Publication Data

US 2006/0244619 A1 Nov. 2, 2006

(51) Int. Cl.
*G08B 23/00* (2006.01)

(52) U.S. Cl. ..... 340/500; 340/520; 340/524

(58) Field of Classification Search ..... 340/500, 340/506, 507, 514, 516, 517, 520, 524, 644; 324/73.1; 335/205, 2–7; 307/326, 327
See application file for complete search history.

(56) References Cited

U.S. PATENT DOCUMENTS

| | | | | |
|---|---|---|---|---|
| 4,146,884 A | | 3/1979 | Kurn | 340/518 |
| 4,638,299 A | | 1/1987 | Campbell | 340/310.14 |
| 5,039,940 A | * | 8/1991 | Johnson et al. | 324/73.1 |
| 5,233,323 A | * | 8/1993 | Burkett et al. | 335/207 |
| 5,805,074 A | * | 9/1998 | Warren et al. | 340/5.54 |
| 6,417,582 B1 | | 7/2002 | Dold et al. | 307/326 |

FOREIGN PATENT DOCUMENTS

| | | |
|---|---|---|
| DE | 2729480 A1 | 1/1979 |
| DE | 4221916 A1 | 1/1994 |

* cited by examiner

*Primary Examiner*—Van T. Trieu
(74) *Attorney, Agent, or Firm*—Richard H. Krukar; Kermit D. Lopez; Luis M. Ortiz

(57) ABSTRACT

A safety interlock circuit wherein the safety interlock switches can report their status. Signal generators associated with the safety interlock switches produce status signals that are transmitted on the wiring of the safety interlock circuit. The present invention is ideal for retrofitting current installations because no additional wiring is required for carrying the status signals.

20 Claims, 7 Drawing Sheets

SAFETY INTERLOCK CIRCUIT WITH DIAGNOSTICS REQUIRING NO EXTRA SIGNAL WIRES

TECHNICAL FIELD

Embodiments relate to safety interlock circuits and safety interlock switches. Embodiments also relate to safety interlock switches that convey their status using the safety interlock circuit itself as a transmission medium. Embodiments are also related to the transmission, reception, and reporting of safety interlock switch status.

BACKGROUND OF THE INVENTION

Equipment and machinery is often capable of injuring or killing a person when it is operated unsafely. For example, a microwave oven can cause death or injury if it is operated with the door open. The open microwave oven door is an unsafe condition. Safety interlock circuits are electric circuits designed to prevent equipment and machinery from operating when an unsafe condition exists. FIG. 1, labeled as "prior art", illustrates a basic safety interlock circuit. In order to function, the circuit must have a signal to carry. The input signal is introduced into the circuit through the circuit input terminal 101. The signal then passes through three safety interlock switches 102 and into a machine input terminal 104. Finally, the signal exits the machine 105 at the machine output terminal 106 and exits the safety interlock circuit at the circuit output terminal 107. The machine 105 only operates if the signal can pass through it. Any opening in the circuit will prevent the machine 105 from operating. A safety interlock switch 102 must be in the closed state for the signal to pass through it. In the safety interlock circuit of FIG. 1, all the safety interlock switches 102 must be closed or the machine 105 will not operate.

Returning to the microwave oven example, the circuit input terminal 101 and circuit output terminal 107 could be the prongs on the power cord that is plugged into the wall. In that case, the signal is the AC line power used to power the microwave oven. One safety interlock switch 102 is the door safety switch that opens whenever the door opens. Another safety interlock switch 102 can be set to open whenever the top cover of the microwave oven is removed. The machine 105 is all the parts that rotate food or generate microwave radiation. In this example, the microwave oven cannot operate with either the door open or top cover removed because a safety interlock switch cuts the AC line power.

Some equipment requires more power than can be safely carried in a safety interlock circuit. In this case, a control module 202 is required as shown in FIG. 2, which is labeled as "prior art". In FIG. 2, the signal passes into the control input terminal 201, through the control module 202, and out the control output terminal 203. Electric power for the machine 105 passes into the power input terminal 204, through the control module 202, through the machine 105, and out the power output terminal 106. The control module 202 switches machine power on and off based on the presence or absence of the signal.

Electric relays are often used for control modules. An electric relay is a common electrical component that uses an electric current as a control signal for opening and closing a switch. Those skilled in the art of electric circuitry know the properties of relays and many functional equivalents of relays wherein a control signal switches power on and off.

Some of the similar devices are transistor, vacuum tubes, silicon controlled rectifiers and field effect transistors.

A significant problem with safety interlock circuits is that it is often impossible to know which particular safety interlock switch is disabling the machinery. In the microwave oven example, it is easy to see if the door is open. However, if the machinery is an elevator in a skyscraper, the open switch could be on any floor of the building. If a safety interlock switch has disabled an elevator, then the time spent by the maintenance crew just to isolate the problem can be considerable. There are safety interlock switches that can report their state, but they also require a dedicated signaling circuit. A safety interlock circuit with such switches is shown in FIG. 3, labeled as "prior art", wherein each switch uses a dedicated signal wire 302 operable through a monitoring module 301. Another safety interlock circuit is shown in FIG. 4, labeled as "prior art", wherein the switches share a common signal bus 401.

Examples of a monitoring module 301 are devices that actively monitor interlock switch position, interlock switch contacts, voltage across the interlock switch contacts, or current through the interlock switch. Certain types of switches can monitor their own switch position because they independently open or close multiple independent circuits.

The solutions of FIG. 3 and FIG. 4 are both used, but they both require signal wires to be installed. There are many installations that already have a safety interlock circuit installed that would benefit from a reporting mechanism for safety interlock switches. However, the wires are already installed and it is often prohibitive to install new wires because some machines are literally miles long.

Current diagnostic solutions for safety interlock circuits require additional wiring and additional switches or switch contacts as well as all the extra time, support circuitry, and expense involved in installing, using and maintaining them.

The present invention directly addresses the shortcomings of the prior art by supplying a signaling mechanism that does not require more wires, switches, or switch contacts than any presently installed safety interlock circuit.

BRIEF SUMMARY

The following summary of the invention is provided to facilitate an understanding of some of the innovative features unique to the present invention and is not intended to be a full description. A full appreciation of the various aspects of the embodiments can be gained by taking the entire specification, claims, drawings, and abstract as a whole.

It is therefore, an aspect of the embodiments to provide safety interlock switches and safety interlock circuits that transmit status signals carrying switch status over the wiring of the safety interlock circuit without requiring additional wiring for status signals.

Another aspect of the embodiments is that the status signals are received by a receiver and interpreted to yield status information about the safety interlock switches. The status information is then reported.

It is a further aspect of certain embodiments that the status signals of many safety interlock switches can be transmitted over a safety interlock circuit without causing interference to one another.

A yet further aspect of the embodiments is that safety interlock switch status can be discerned regardless of whether a switch is open or closed.

DETAILED DESCRIPTION

Aspects of the embodiments overcome the limitations of the prior art by using the wires that carry the interlock signal to also transmit signals that carry the switch status instead of using separate wires or a bus to carry the switch status.

Figure 1:
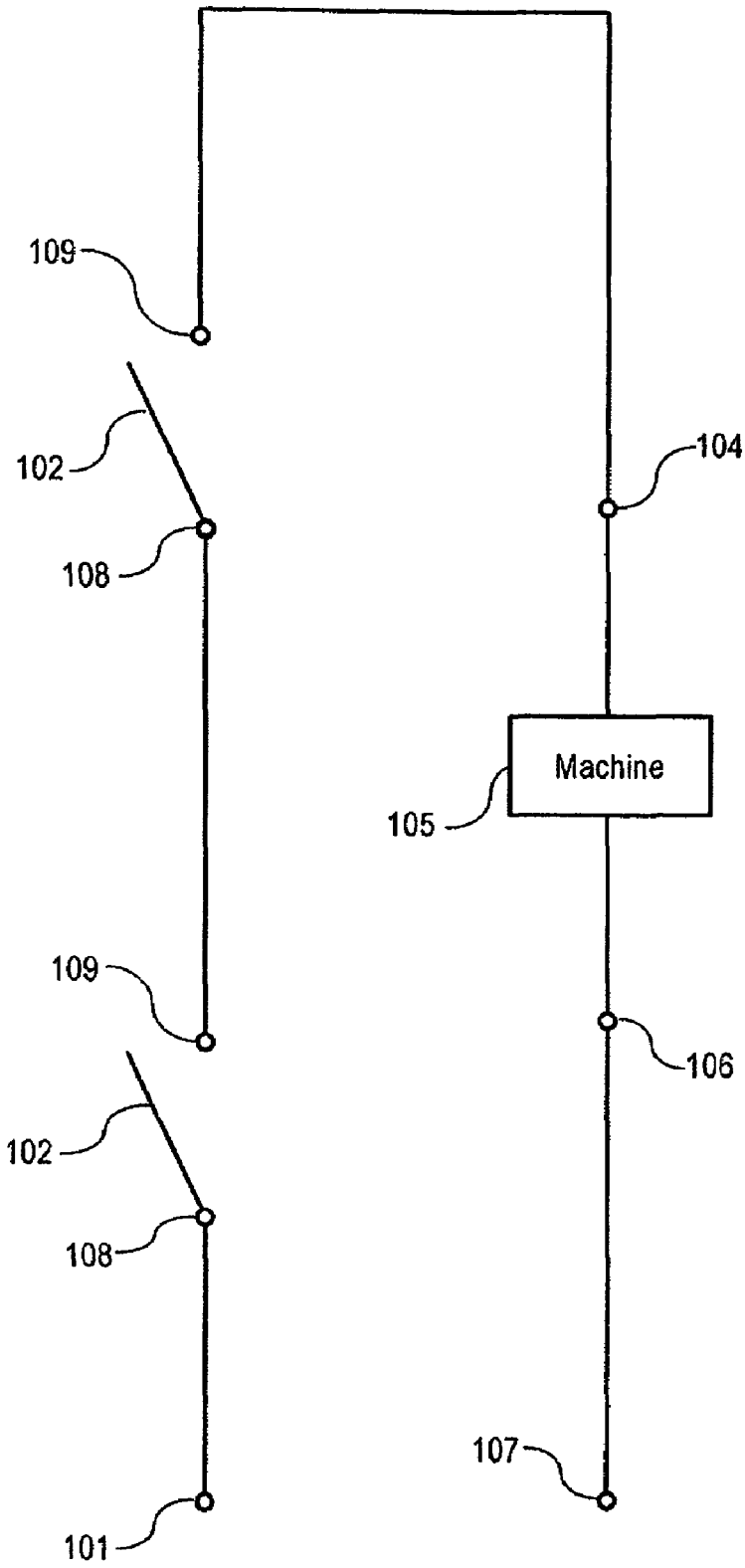
FIG. 1 ( Prior Art )
FIG. 1, labeled as "prior art", illustrates a safety interlock circuit.
Figure 2:
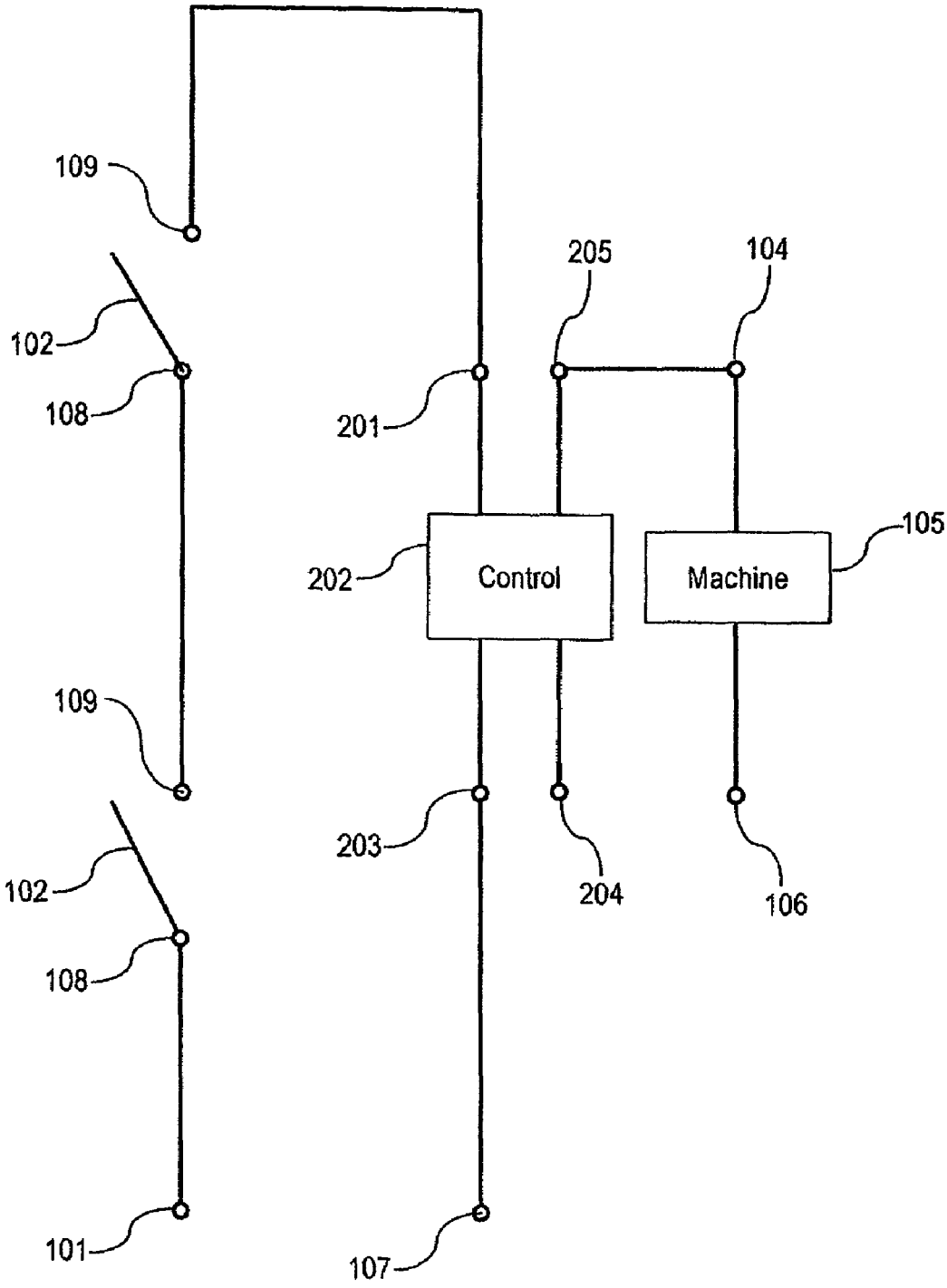
FIG. 2 ( Prior Art )
FIG. 2, labeled as "prior art", illustrates another safety interlock circuit.
Figure 3:
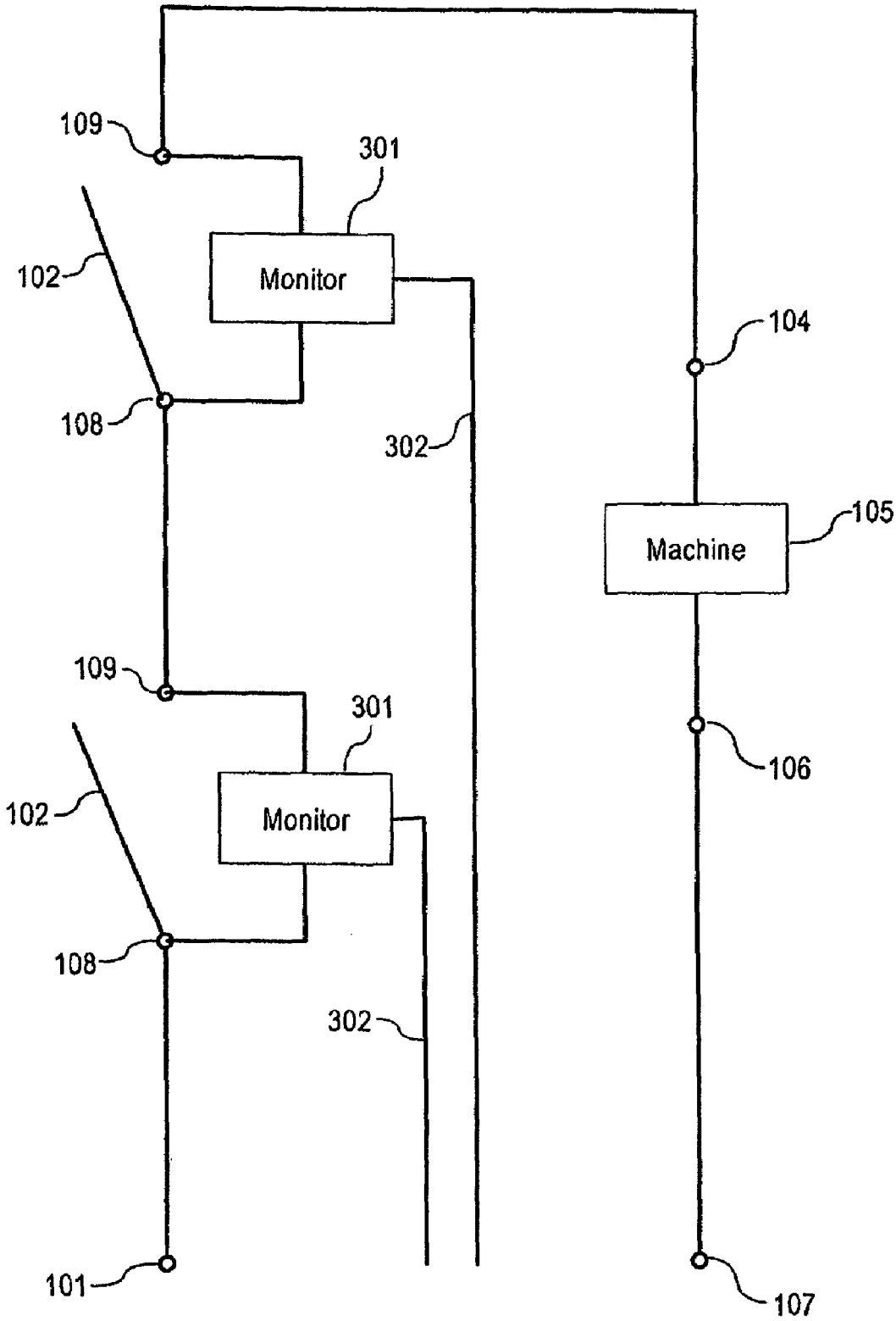
FIG. 3 ( Prior Art )
FIG. 3, labeled as "prior art", illustrates a safety interlock circuit with switch monitoring.
Figure 4:
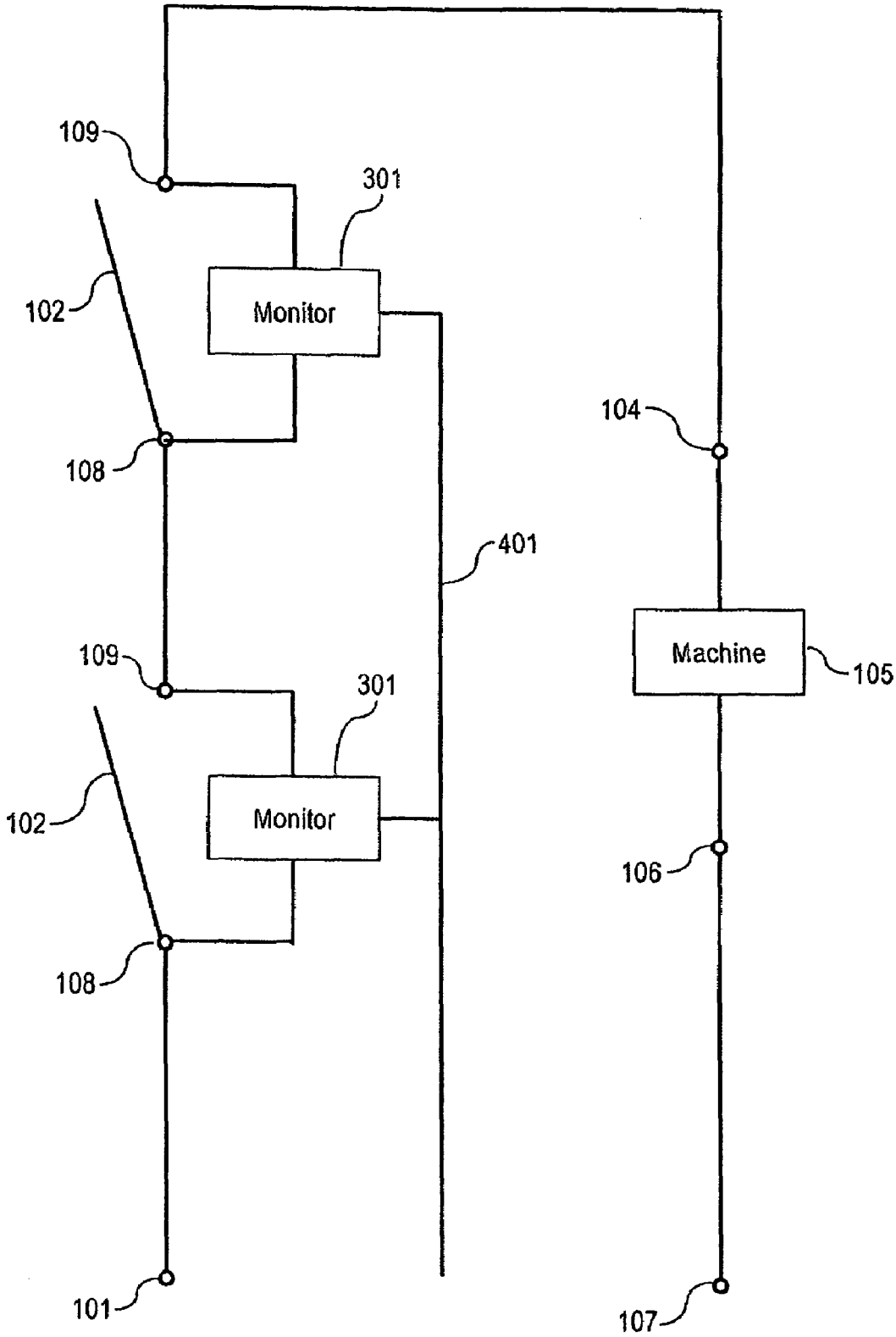
FIG. 4 ( Prior Art )
FIG. 4, labeled as "prior art", illustrates another safety interlock circuit with switch monitoring.
Figure 5:
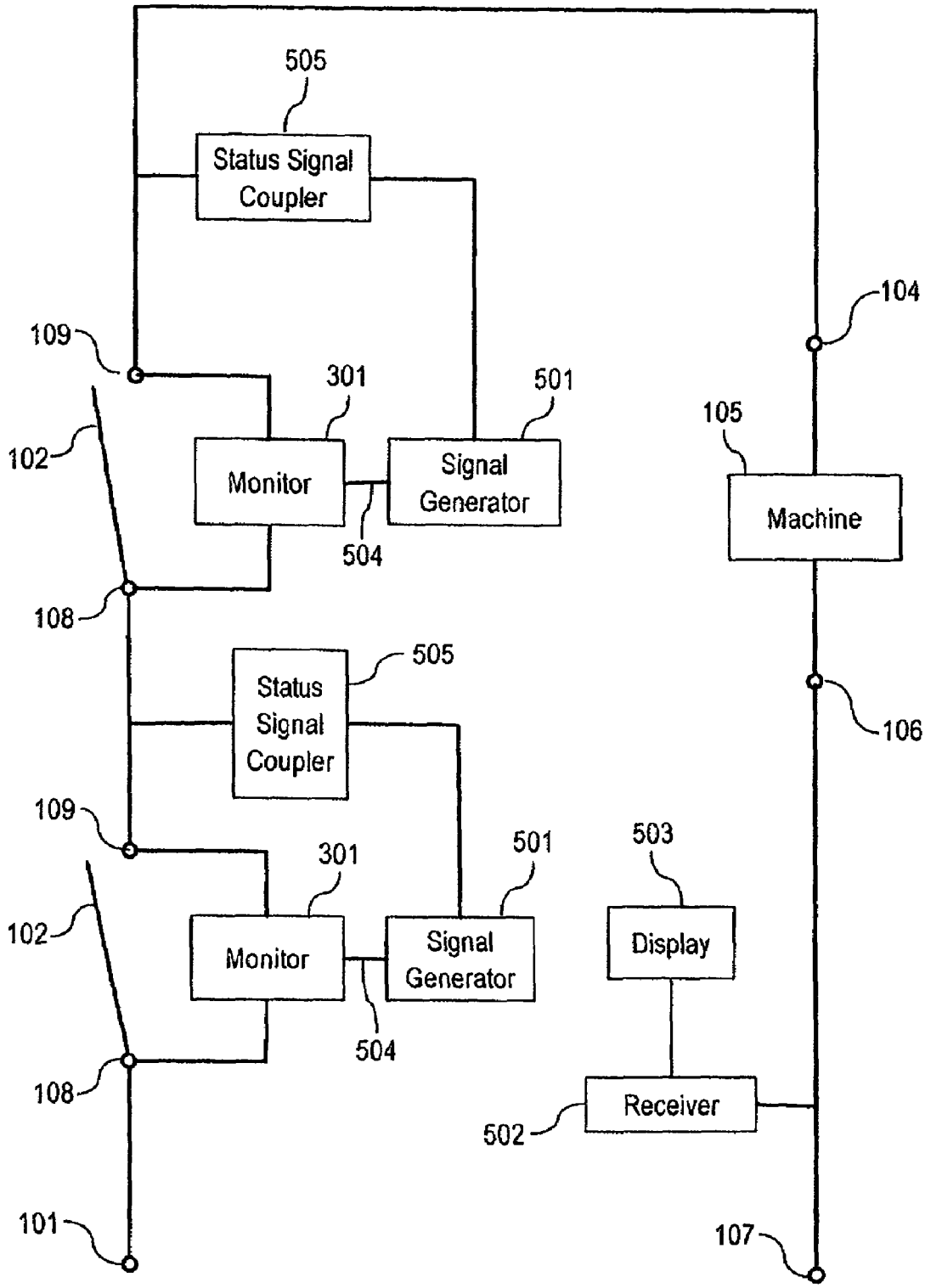
FIG. 5 illustrates a functional block diagram of a safety interlock circuit with switch monitoring in accordance with a feature of an embodiment.

FIG. 5 illustrates one aspect of the embodiments. The interlock signal is introduced into the interlock circuit 100 at the circuit input terminal 101. The interlock signal then passes into a safety interlock switch input terminal 108. The interlock signal then passes through the safety interlock switch 102 if it is closed and then passes out the safety interlock output terminal 109. If the safety interlock switch 102 is open, the interlock signal can't pass. The monitor 301 detects the open safety interlock switch 102 and causes the signal generator 501 to generate a status signal. The status signal passes from the signal generator 501 through the status signal coupler 505 and into the safety interlock circuit at the safety interlock switch output terminal 109. From that point, the status signal can pass through other safety interlock switches until it eventually reaches the machine 105.

Those skilled in the arts of electrical circuitry or electrical signaling are familiar with a vast array of electrical signals, devices for generating those signals, and techniques for coupling those signals into and out of electrical circuits. On contemplation of the embodiments, they could use their skill to produce aspects of the embodiments.

Another aspect of the embodiments is that the status signal cannot cause the machine 105 to operate; only the interlock signal can cause the machine 105 to operate. From the machine 105, the signal passes to the interlock circuit output terminal 107. However, before the status signal passes out of the safety interlock circuit 100, a receiver 502 can receive it. The receiver 502 then causes the reporter 503 to report some property or properties of the status signal. Some properties of status signals are the presence of the status signal, information that can be used to identify the signal generator that produced the status signal or status information carried by the status signal. The reporter can report by directly displaying information to a person, sounding an alarm, sending a message to a web site for remote display, or otherwise generating an audible, visual, or electrical signal.

A signal is something that may be used to carry information. An aspect of the embodiments is transmitting electrical signals over the wires of the safety interlock circuit. The art of communications systems has found many different types of electrical signals. The embodiments do not require any particular type of electrical signal, only that there be an electrical signal. When two or more signals are present, there is a possibility they will interfere. Interference is when one signal obscures or degrades another. The art of communications systems has found many ways to avoid interference between signals. For purposes of the embodiments, all types of electrical signal are considered equivalent and techniques for avoiding interference between signals are considered equivalent. Techniques for avoiding interference between status signals include, but are not limited to, status signal modulation, time division, collision detection, or collision avoidance In the art of communications systems, modulation is the technique by which signals are caused to carry information. One of the simplest examples is the famed "one if by land, two if by sea" leading to the midnight ride of Paul Revere. A very complicated example is the IEEE 802.11g standard that governs certain wireless Ethernet transmissions. Aspects of the embodiments do require modulation of a signal. More specifically, status information is carried by the status signal. All the modulation techniques by which status information, which includes a switch's open/close position and identity, can be carried by a status signal are considered equivalent for purposes of the embodiments.

Status information is the information that a status signal carries. An example is a status signal that is present only when a particular safety interlock switch is open. When that status signal is not detected at the receiver 502, then the status information is that the safety interlock switch is closed. When that status signal is detected at the receiver 502, then the status information is that the switch is open. Another possibility is that a signal generator 501 can generate one status signal when the safety interlock switch 102 is open and a different signal when it is closed. In this manner the status information is that the presence of one signal indicates that a particular switch is open, the presence of the other signal indicates closed, and the absence or presence of both signals indicates an abnormal condition.

Another aspect of the embodiments is that the status signal must be incapable of causing the machine 105 to operate. Only the interlock signal can cause the machine 105 to operate. As previously described, the interlock signal is often also the electric power for the machine, such as AC line current for home appliances or 12 volt DC power from a car battery. Historically, there are many instances of signaling via power lines. The methods used to signal via power lines can also be used to for sending and receiving status signals in interlock circuits. However, the embodiments are not limited to any particular signaling method or group of signaling methods. All signaling methods by which an interlock circuit carries both an interlock signal and a status signal are considered equivalent for purposes of the embodiments.

A further aspect of the embodiments is coupling the status signal into the wiring of the safety interlock circuit. There are many techniques known in the art of electric circuitry for coupling a signal into a circuit. Capacitive coupling, inductive coupling, and direct wiring are examples of coupling techniques. The embodiments do not depend on the application of any one coupling technique or group of techniques. All techniques that couple a status signal from a signal generator 501 into a safety interlock circuit are considered equivalent.

A signal generator 501 is a device that produces a status signal. Aspects of certain embodiments require that every signal generator 501 produce a unique signal. A unique signal is a signal that is unlike any other signal that is intentionally present in the interlock circuit. The reason unique signals are required is so that signal generators can be identified by the signals they produce. Every signal generator in the embodiments is associated with a safety interlock switch. Therefore, a unique signal can be used to identify a safety interlock switch. Additionally, aspects of certain embodiments require a signal generator to produce 2 different signals. If both signals are unique, they can be used to identify the signal generator and thereby the safety interlock switch. Any signal that is not unique can not be used to identify a specific source.

Figure 6:
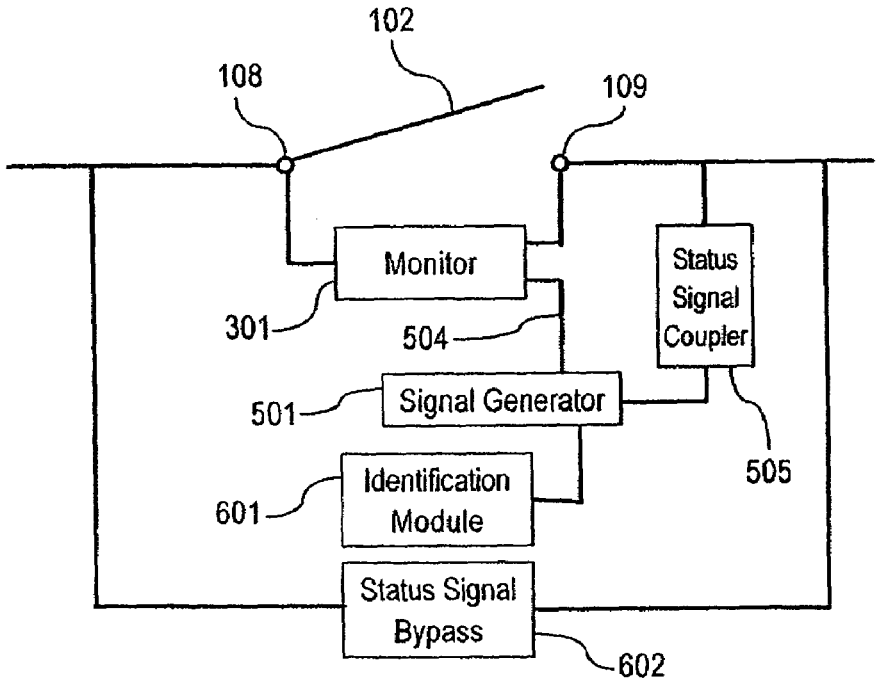
FIG. 6 illustrates a functional block diagram of a safety interlock switch combined with other components for monitoring and status reporting accordance with another feature of an embodiment.

In accordance with aspects of certain embodiments, FIG. 6 illustrates an apparatus 600 that associates an identification module 601 with each safety interlock switch 102 in the system. The reason is that every signal generator 501 must produce a unique signal. The identification module 601 is a device such as a block of jumpers, a DIP switch or electronically programmable memory by which every signal generator 501 in the system can be adjusted to emit a different signal. The safety interlock circuit of FIG. 5 does not show use of a switch identification, in which case the signal generators 501 must be distinguishable by some other mechanism. In FIG. 6, the interlock signal passes through the safety interlock switch 102 when it is closed. However, when it is open the monitor 301 detects it and causes the signal generator 501 to produce a signal that is coupled into the interlock circuit at the safety interlock circuit output terminal 109. The signal generator 501 generates a status signal that is dependent on the identification module 601. An example is a signal generator that produces a sinusoidal signal wherein the frequency is set based on the signal identification. In this example, the sinusoidal frequency is the status information. The receiver can use the frequency to identify the signal generator 501 and thereby also identify a specific safety interlock switch 102. A reporter, such as reporter 503 in FIG. 5, can then be used to report the status of the safety interlock switch 102.

FIG. 6 also illustrates another aspect of certain embodiments, the status signal bypass 602. The status signal bypass 602 is used to supply a signaling path for status signals but not for interlock signals. An interlock signal cannot pass from the input of the safety signal bypass 602 to the output. A status signal can pass from the input of the status signal bypass 602 to the output. It is possible for a status signal to be present at the safety interlock switch input terminal 108. An open safety interlock switch 102 will not pass any signal, including a status signal. An example of when this can occur is when more than one safety interlock switch is open. A status signal bypass 602 carries status signals past the safety interlock switch 102. In this manner, the safety interlock circuit can carry many status signals at once. A receiver 502 can receive all the signals and a reporter 503 can report the status information. An implication of this aspect of the embodiments is that many status signals must be able to coexist without interfering with one another. Signaling techniques whereby many signals share the same transmission medium, whether that medium is a wire, the air, or an optical fiber, are common. All the signaling techniques whereby many status signals can share the wires of the safety interlock circuit are considered equivalent for purposes of the embodiments.

Figure 7:
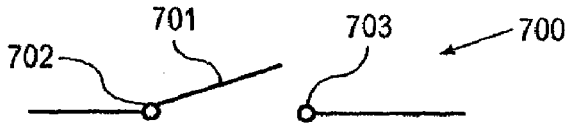
FIG. 7 ( Prior Art )
FIG. 7, labeled as "prior art", illustrates a single pole single throw switch.

FIG. 7, labeled as "prior art", shows a common circuit symbol for a single pole single throw (SPST) switch 700. Most switches do not have an input terminal or output terminal because they conduct electricity equally in either direction. When the switch 701 is closed, it conducts electricity, in either direction, between terminal1 702 and terminal2 703. The circuit symbol appears to show the switch in the open position, however that is not the case because the symbol does not indicate open or closed, it only indicates that there is a switch.

Figure 8:
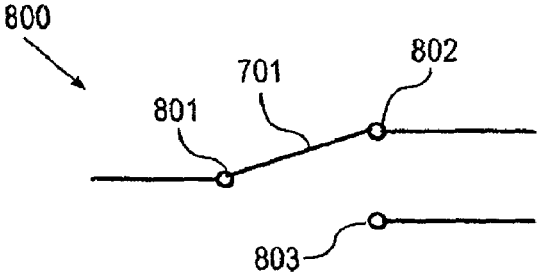
FIG. 8 ( Prior Art )
FIG. 8, labeled as "prior art", illustrates a single pole double throw switch.

FIG. 8, labeled as "prior art", shows a common circuit symbol for a single pole double throw (SPDT) switch 800. When the switch 701 is in one position, it conducts electricity, in either direction, between terminal1 801 and terminal2 802. When the switch 701 is in the other position, it conducts electricity, in either direction, between terminal1 801 and terminal2 803. The circuit symbol appears to show the switch in one position, however that is not the case because the symbol does not indicate switch position; it only indicates that there is a switch.

Figure 9:
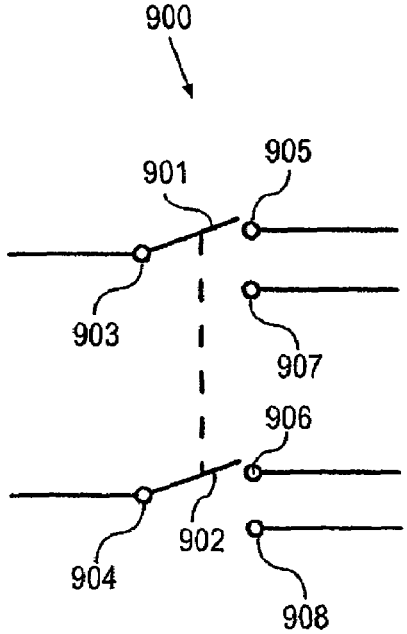
FIG. 9 ( Prior Art )
FIG. 9, labeled as "prior art", illustrates a double pole double throw switch.

FIG. 9, labeled as "prior art", shows a common circuit symbol for a double pole double throw (DPDT) switch 900. It has a switching mechanism that moves two switches at the same time. When the switching mechanism is in one position, one switch 901 conducts electricity, in either direction, between terminalA1 903 and terminalA2 905 and the other switch 902 conducts electricity, in either direction, between terminalB1 904 and terminalB2 906. When the switching mechanism is in the other position, one switch 901 conducts electricity, in either direction, between terminalA1 903 and terminalA3 907 and the other switch 902 conducts electricity, in either direction, between terminalB1 904 and terminalB2 908. The circuit symbol appears to show the switching mechanism in one position, however that is not the case because the symbol does not indicate switch position; it only indicates that there is a switch.

Figure 10:
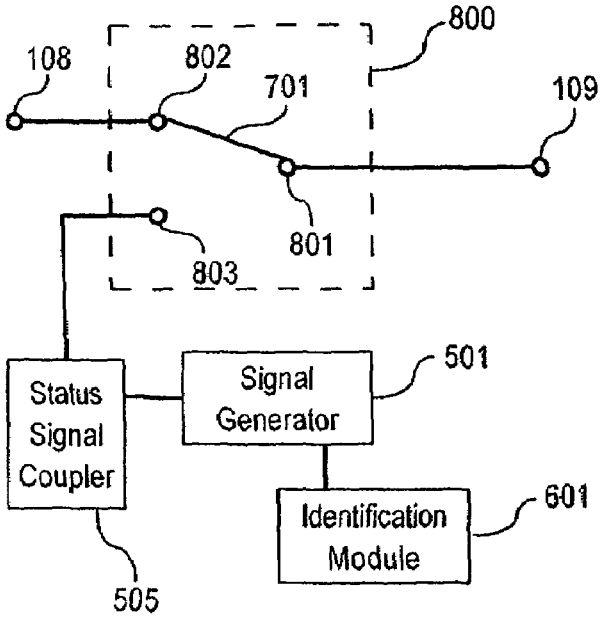
FIG. 10 illustrates a single pole double throw switch combined with other components for monitoring and status reporting accordance with a further feature of an embodiment.

FIG. 10 shows the apparatus of FIG. 5 adapted to use a SPDT switch. The SPDT switch 800 is used as both the safety interlock switch 102 and the monitor 301. Terminal2 802 is connected to the safety interlock switch input terminal 108 and terminal1 801 is connected to the safety interlock switch output terminal 109. The closed position of the safety interlock switch 102 corresponds to the SPDT switch 800 conducting electricity between terminal1 801 and terminal2 802. The signal generator 501 is connected to SPDT switch 800 terminal3 803. The open position of the safety interlock safety switch 102 corresponds to the SPDT switch 800 conducting electricity between terminal1 801 and terminal3 803. When the safety interlock switch 102 is open, the signal generator 501 is electrically connected to the safety interlock circuit by the SPDT switch.

Figure 11:
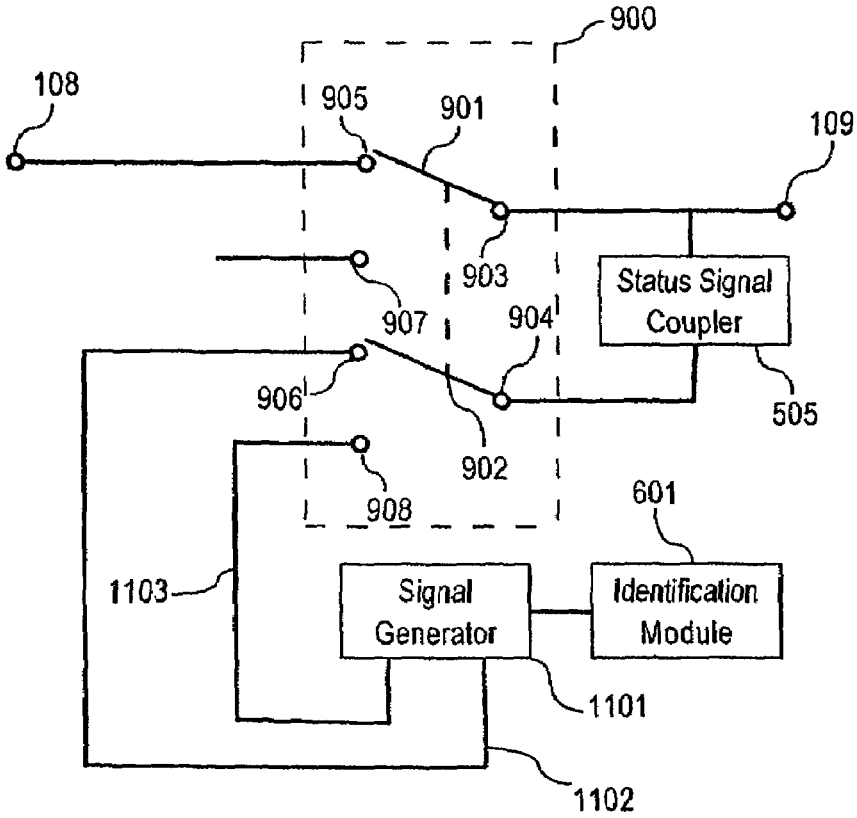
FIG. 11 illustrates a double pole double throw switch combined with other components for monitoring and status reporting accordance with an additional feature of an embodiment.

FIG. 11 shows the apparatus of FIG. 5 adapted to use a DPDT switch. The DPDT switch 900 is used as both the safety interlock switch 102 and the monitor 301. TerminalA2 905 is connected to the safety interlock switch input terminal 108 and terminalA1 903 is connected to the safety interlock switch output terminal 109. The closed position of the safety interlock switch 102 corresponds to the DPDT switch 900 conducting electricity between terminalA1 903 and terminalA2 905 and between terminalB1 904 and terminalB2 906. The signal generator 1101 shown here generates two different status signals and sends status signal1 to the status signal1 line 1102 that is connected to DPDT switch 900 terminalB2 906. It sends status signal2 to the status signal2 line 1103 that is connected to DPDT switch 900 terminalB3 908. When the safety interlock switch 901 is closed, the interlock signal passes through the DPDT switch 900 and status signal1 also passes through the switch and it is coupled into the safety interlock circuit via the status signal coupler 505. The open position of the safety interlock switch 102 corresponds to the DPDT switch 900 conducting electricity between terminalA1 903 and terminalA3 907 and between terminalB1 904 and terminalB3 908. When the safety interlock switch 901 is open, the interlock signal cannot pass through the DPDT switch 900 but status signal2 does pass through the switch and it is coupled into the safety interlock circuit via the status signal coupler.

It will be appreciated that variations of the above-disclosed and other features, aspects and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The embodiments of the invention in which an exclusive property or right is claimed are defined as follows. Having thus described the invention, what is claimed is:

1. An electric circuit comprising:

a reporting interlock switch comprising a safety interlock switch, a status signal generator electrically connected to a status signal coupler that is electrically connected to at least one terminal of the safety interlock switch, and a monitor that turns the generator on and off based on the state of the safety interlock switch;

a control module wired in series with the safety interlock switch wherein the control module disables machinery when the switch is open;

a receiver electrically connected to the reporting interlock switch that receives status signals in the electric circuit;

a decoder connected to the receiver that obtains status signal information from the status signals received by the receiver; and a reporter to report the status signal information.

2. The electric circuit of claim 1 wherein multiple reporting interlock switches are electrically connected in series to each other and to the control module, and each status signal generator produces a status signal unlike that produced by any other status signal generator in the circuit.

3. The electric circuit of claim 2 wherein the safety interlock switch and the monitor are both instantiated by a double throw single pole switch.

4. The electric circuit of claim 3 wherein each reporting interlock switch incorporates a status signal bypass that conducts status signals between the terminals of the safety interlock switch.

5. The electric circuit of claim 1 wherein the control module is an electric relay that disables machinery by switching off electric power whenever the relay's coil is not energized.

6. The electric circuit of claim 5 wherein each reporting interlock switch incorporates a status signal bypass that conducts status signals between the terminals of the safety interlock switch.

7. The electric circuit of claim 1 wherein the safety interlock switch and the monitor are both instantiated by a single throw double pole switch.

8. An electric circuit comprising:

a reporting interlock switch comprising a safety interlock switch, a status signal generator electrically connected to a status signal coupler that is electrically connected to at least one terminal of the safety interlock switch, and a monitor that causes the generator to emit one status signal when the safety interlock switch is open and another status signal when it is closed;

a control module wired in series with the safety interlock switch wherein the control module disables machinery when the switch is open;

a receiver electrically connected to the reporting interlock switch that receives status signals in the electric circuit;

a decoder connected to the receiver that obtains status signal information from the status signals received by the receiver; and a reporter that reports status signal information.

9. The electric circuit of claim 8 wherein multiple reporting interlock switches are electrically connected in series to each other and to the control module, and each status signal generator produces at least one status signal unlike those produced by any other status signal generator in the circuit.

10. The electric circuit of claim 9 wherein the safety interlock switch and the monitor are both instantiated by a double throw double pole switch.

11. The electric circuit of claim 10 wherein each reporting interlock switch incorporates a status signal bypass that conducts status signals between the terminals of the safety interlock switch.

12. The electric circuit of claim 8 wherein each reporting interlock switch incorporates a status signal bypass that conducts status signals between the terminals of the safety interlock switch.

13. The electric circuit of claim 12 wherein the safety interlock switch and the monitor are both instantiated by a double throw double pole switch.

14. The electric circuit of claim 8 wherein the safety interlock switch and the monitor are both instantiated by a double throw double pole switch.

15. A diagnostic method comprising:

creating a status signal that uniquely identifies a corresponding safety interlock switch;

injecting the status signal into a safety interlock circuit when the corresponding safety interlock switch is in an open state;

receiving the status signal;

interpreting the status signal to obtain the identity of the corresponding safety interlock switch; and reporting the identity of the corresponding safety interlock switch.

16. The method of claim 15 further comprising the steps of specifying status information that indicates the switch state, and including the status information in the status signal.

17. The method of claim 16 further comprising the step of injecting the status signal into the safety interlock circuit when the safety interlock switch is in the closed state.

18. The method of claim 17 further comprising the step of avoiding interference between status signals.

19. The method of claim 15 further comprising the step of avoiding interference between status signals.

20. The method of claim 16 further comprising the step of avoiding interference between status signals.

* * * * *